US006997395B2

(12) United States Patent
Kawamoto

(10) Patent No.: US 6,997,395 B2
(45) Date of Patent: Feb. 14, 2006

(54) FLUID INJECTION AND RECOVERY DEVICE

(75) Inventor: Eiichi Kawamoto, Fukuyama (JP)

(73) Assignee: Sanyo Aqua System Co., Ltd., Tokyo (JP)

( * ) Notice: Subject to any disclaimer, the term of this patent is extended or adjusted under 35 U.S.C. 154(b) by 185 days.

(21) Appl. No.: 10/408,677

(22) Filed: Apr. 8, 2003

(65) Prior Publication Data

US 2004/0016824 A1 Jan. 29, 2004

(30) Foreign Application Priority Data

Apr. 10, 2002 (JP) ..... 2002-107737
Feb. 3, 2003 (JP) ..... 2003-026403

(51) Int. Cl.
*A62C 13/62* (2006.01)

(52) U.S. Cl. ..... 239/302; 310/304; 310/124; 310/127; 310/575; 310/507; 310/533.15; 310/512; 15/320; 15/321; 15/353; 134/10; 134/21; 134/36; 134/172

(58) Field of Classification Search ..... 239/310, 239/315, 304, 305, 124, 127, 575, 533.1, 239/504, 533.15, 507, 509, 512; 15/320, 15/321, 353; 134/10, 21, 36, 172
See application file for complete search history.

(56) References Cited

U.S. PATENT DOCUMENTS 3,380,658 A * 4/1968 Stasz et al. ..... 239/130
4,083,705 A 4/1978 Parise et al.
4,466,155 A * 8/1984 Grave ..... 15/321
4,696,075 A 9/1987 Grave
5,180,439 A * 1/1993 Allison ..... 134/21
5,589,080 A 12/1996 Cho et al.
5,704,989 A * 1/1998 Page ..... 134/10
5,718,015 A * 2/1998 Rohrbacher ..... 15/321
6,016,973 A * 1/2000 Thompson et al. ..... 239/304

FOREIGN PATENT DOCUMENTS

DE 41 22 527 7/1992
DE 195 22 893 2/1996
JP 2001-161762 6/2001
WO WO 01/53001 A1 7/2001

OTHER PUBLICATIONS

European Search Report Dated Aug. 18, 2003.

* cited by examiner

*Primary Examiner*—David A. Scherbel
*Assistant Examiner*—Seth Barney
(74) *Attorney, Agent, or Firm*—Nixon Peabody LLP

(57) ABSTRACT

The present invention provides a fluid injection and recovery device capable of spraying a fluid over an object, recovering at least, the sprayed fluid, as well as filtering and recycling the recovered fluid. This fluid injection and recovery device comprises: a main tank capable of containing fluid; a filter unit capable of filtering the fluid contained in the main tank; a fluid sprayer for spraying the fluid filtered with the filter unit over an object; and a recovery unit capable of recovering, into the main tank, the fluid sprayed over the object and the matter removed by the fluid.

18 Claims, 9 Drawing Sheets

FLUID INJECTION AND RECOVERY DEVICE

BACKGROUND

The present invention relates to a fluid injection and recovery device for spraying (or injecting) fluid over an object, recovering at least, the fluid sprayed over the object, as well as filtering and recycling the recovered fluid.

Conventionally, it would be relatively difficult to remove and clean unwanted matter adhered to objects (or cleaned objects) such as walls, ceilings, floors, bathroom surfaces, furniture, equipment such as ventilating fans or air conditioners, and vehicles such as cars, motorcycles, or bicycles. Particularly, it would be very difficult to wipe or wash off grease adhered to these cleaned objects with a normal cleaning solvent.

Accordingly, a cleaning device that cleans unwanted matter off with a spraying force of a cleaning solvent sprayed on the unwanted matter adhered to the cleaned object has recently been suggested. Moreover, any unwanted matter that cannot be cleaned off by the cleaning device is removed by, for example, further scrubbing the unwanted matter with a cloth, a scrubber, a mop or the like. However, when this cleaning device is used to clean off the unwanted matter adhered to horizontal surfaces such as floors, the cleaning solvent sprayed over the floors or other horizontal surfaces and the unwanted matter removed by the cleaning solvent (the "sprayed cleaning solvent" and the "unwanted matter removed by the cleaning solvent" may be collectively and simply referred to as "wastewater" below) remain on the floors or other horizontal surfaces. Accordingly, it is necessary to further wipe them with,.for example, a cloth.

Moreover, when the unwanted matter adheres to vertical surfaces such as walls, or ceilings or the like, the cleaning solvent sprayed over them and the unwanted matter removed by the cleaning solvent runs down. Therefore, it is necessary to wipe the wastewater with, for example, a cloth. If the wastewater runs or falls onto any clean part of the vertical surfaces or ceilings, it is also necessary to clean this part. Furthermore, if flowerpots, furniture, electric appliances or the like are placed under the wall or ceiling to be cleaned, and if the cleaning solvent runs or falls onto them, problems of losing the plant, or damaging the furniture or failure of the electric appliances may result. Accordingly, in this case, when cleaning the unwanted matter off the walls or ceilings, it is necessary to cover the flowerpot, furniture, electric appliances or the like with, for example, a vinyl sheet so that the wastewater will not fall onto them directly.

As the number of elderly persons, who need care because they are bedridden or suffer from dementia, has been increasing sharply recently, the care of such persons, particularly the disposal of excrement, has become a very important issue. Diapers are generally used for the disposal of excrement of the elderly persons in the above-described conditions. Specifically speaking, the disposal of excrement is now conducted by changing diapers regularly or once they are soiled. However, just changing diapers will leave residual excrement on the body, giving rise to problems of sanitary management. Accordingly, it is still necessary to remove the residual excrement on the body when changing diapers.

Such a task has been conducted by using commercially available cleaning items or hot wet towels. Namely, the current way of removing the residual excrement is for a caregiver to directly wipe a feculent part of the body of an elderly person, that is, the residual excrement on the body.

However, the residual excrement on the body often solidifies by the time of changing diapers and much time and labor is required for the removal of the excrement.

Therefore, the applicant of this invention has suggested, in Japanese Patent Laid-Open (Kokai) Publication No. 2001-161762, a suction device capable of easily sucking in and removing the above-described matter, such as dirt.

When the type of suction device that sucks in and recovers the wastewater is used, the wastewater will neither remain on the cleaned object nor run down, and thus the cleaning work is simplified. However, the recovered wastewater is disposed of and cannot be recycled as the cleaning solvent. Accordingly, a large amount of the cleaning solvent is consumed and the amount of the used cleaning solvent and the wastewater cannot be reduced.

SUMMARY

The present invention aims to improve the above-described conventional suction device. It is an object of this invention to provide a fluid injection and recovery device capable of spraying (or expelling) fluid over an object, recovering at least, the sprayed fluid into the main tank, as well as filtering and recycling the recovered fluid.

In order to achieve the above-described object, this invention provides a fluid injection and recovery device comprising: a main tank capable of containing a fluid; a filter unit which is connected to the main tank and is capable of filtering the fluid contained in the main tank; a fluid sprayer which is connected to the filter unit and sprays the fluid filtered by the filter unit over an object; and a recovery unit which is connected to the main tank and is capable of recovering, into the main tank, at least, the fluid sprayed over the object.

The fluid injection and recovery device having the above-described construction can filter, by means of the filter unit, the fluid which has been recovered by the recovery unit into the main tank, and can spray the filtered fluid from the fluid sprayer over the object. Accordingly, it is possible to recycle the fluid efficiently and to lengthen the intervals to refill the main tank with the fluid. Moreover, since at least, the fluid sprayed from the fluid sprayer over the object is recovered into the main tank without fail, for example, the fluid will neither splash nor fall onto or around the object. Therefore, it is possible to use the fluid injection and recovery device with certainty in various places.

There is no specific limitation on the "object" referred to in relation to this invention, as long as it is the object over which the fluid expelled out of the fluid injection and recovery device of this invention can be sprayed. Examples of the object include a variety of surfaces, such as walls, ceilings, floors, bathroom surfaces, toilets, furniture, appliances such as ventilating fans or air conditioners, vehicles such as cars, motorbikes, or bicycles, various kinds of machines, materials such as concrete, stones, or metals, and bodies of human beings or other animals.

The recovery unit can recover the fluid sprayed over the object as well as the matter removed by the fluid.

By employing this construction, it is also possible to recover, with certainty, the matter removed by the fluid sprayed by the fluid sprayer over the object.

There is no specific limitation on the "matter removed by the fluid" as referred to in relation to this invention, as long as the matter can be removed by the fluid sprayed by the fluid sprayer over the object. Examples include a variety of matter such as chips created when the object is cut by high-pressure fluid (such as a water jet), or bits (such as dead skin) peeling off the object (such as the body or face of a human being or animal) when a massage action is applied to the object by using the fluid.

The invention can be constructed in such a manner that the recovery unit comprises a suction hose connected to the main tank, and a nozzle connected to the top end of the suction hose, and the nozzle includes an opening, which can be placed facing the object, and a suction hole for sucking in at least, the fluid sprayed over the object, and the nozzle is connected to the top end of the fluid sprayer.

By employing this construction, in addition to the aforementioned advantageous effects, it is possible to spray the fluid (or to make the fluid work) more efficiently via the nozzle over the object.

Moreover, the suction hole can be used to suck in the fluid sprayed over the object as well as the matter removed by the fluid.

Concerning the fluid injection and recovery device of this invention, the main tank can be connected to the suction unit for sucking gas contained in the main tank, thereby creating negative pressure in the main tank.

Furthermore, the invention can be constructed in such a manner that the fluid is a liquid, and the suction unit includes a gas-liquid separator for separating gas from liquid in the main tank and sucks the gas contained in the main tank through the gas-liquid separator, thereby creating negative pressure in the main tank.

The invention can be constructed in such a manner that the gas-liquid separator comprises a fluid chamber into which a gas-liquid mixture is introduced, and a spiral flow is generated in the fluid chamber, thereby separating gas from liquid according to the cyclone principle.

Moreover, the recovery unit can employ the negative pressure in the main tank in order to recover, into the main tank, at least, the fluid sprayed over the object.

Furthermore, the recovery unit can recover the fluid sprayed over the object and the matter removed by the fluid.

As one aspect of the fluid sprayer, it can comprise: a fluid supply tube connected to the filter unit; and a pump for supplying the fluid filtered by the filter unit to the fluid supply tube, thereby causing the fluid to eject out of the top end of the fluid supply tube.

The main tank can be connected to a supply tank for refilling the main tank with the fluid.

More specifically, the main tank can be connected through a cock to a supply tank for refilling the main tank with the fluid, and when the cock is in the open position, the negative pressure in the main tank can cause the fluid in the supply tank to move to the main tank.

By employing this construction, it is possible to refill the main tank with the fluid merely by opening the cock even during the operation of the fluid injection and recovery device and without interrupting its operation.

The main tank can be connected to a thermoregulator capable of adjusting the temperature of the fluid contained in the main tank.

By employing this construction, it is possible to maintain the temperature of the fluid sprayed over the matter adhered to the object at an optimum temperature for the removal of the matter. Therefore, it is possible to conduct the cleaning work more efficiently.

Any fluid can be selected as the fluid contained in the main tank, depending on the purpose of use. Examples of the fluid include water (or hot water), water vapor, alkaline cleaning solvents or much stronger alkaline cleaning solvents, chlorine cleaning solvents such as bleaching agents or fungicides, neutral detergents, alcohol disinfectants, cosmetic lotions, cosmetic toners, cosmetic essence, moisture lotions, or solutions or vapors containing aromatic essence. It is also possible to choose the temperature, spray amount, and other conditions of the fluid as appropriate, according to the type and purpose of use of the fluid.

The fluid injection and recovery device of this invention can further comprise a sub-tank capable of containing the fluid, wherein the filter unit and the sub-tank can be connected through a switching valve to the fluid sprayer, and supplying the fluid to the fluid sprayer can be controlled by the operation of the switching valve.

Moreover, this invention can be constructed in such a manner that the fluid contained in the sub-tank is a finishing liquid for cleaning, and the fluid sprayed from the main tank over the object and residue of the matter removed by the fluid are recovered by the recovery unit into the main tank.

If the above-described construction is employed, even if the cleaning solvent such as an alkaline cleaning solvent is contained in the main tank, it is possible to remove and recover, with certainty, the cleaning solvent and the residue of the matter removed by the fluid by first using the cleaning solvent to remove (or clean) the matter (such as dirt), and then switching the switching valve to spray the finishing liquid for cleaning from the fluid sprayer over the area that has been cleaned. Accordingly, the labor of wiping becomes unnecessary, which further simplifies the cleaning work. An example of the finishing liquid for cleaning is water (or hot water).

The fluid injection and recovery device of this invention can further comprise a pressure control unit for controlling the pressure of the fluid expelled out of the fluid sprayer.

When this construction is employed and if the pressure of the fluid is increased, it is possible to cut into concrete, stones, metals or the like with, for example, a water jet. Moreover, if the pressure of the fluid is set at some value that would make a human or an animal feel comfortable when the fluid is sprayed over his/her face or body, it is possible to achieve a massage effect or facial treatment effects.

Furthermore, the fluid injection and recovery device of this invention can further comprise a flow volume control unit for controlling the flow volume of the fluid expelled out of the fluid sprayer.

DETAILED DESCRIPTION

Embodiments of the fluid injection and recovery device according to this invention are explained with reference to the attached drawings. Embodiments 1 through 3 are described below for purposes of illustration of this invention, and this invention is not limited to these embodiments. Therefore, this invention can be implemented in various manners unless such variations depart from the gist of the invention.

(Embodiment 1)

Figure 1:
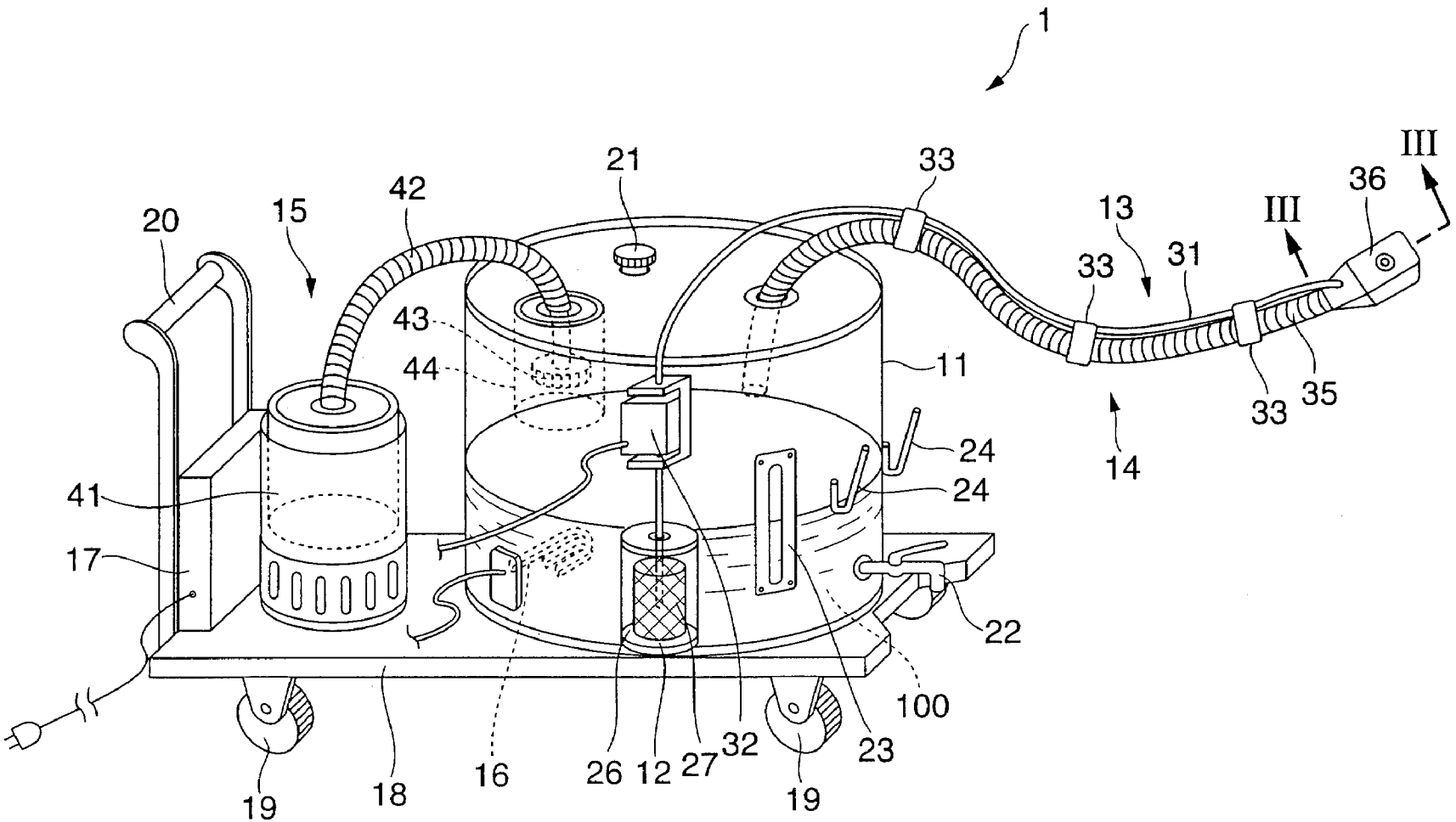
FIG. 1 is a schematic view of the fluid injection and recovery device according to Embodiment 1 of this invention.
Figure 2:
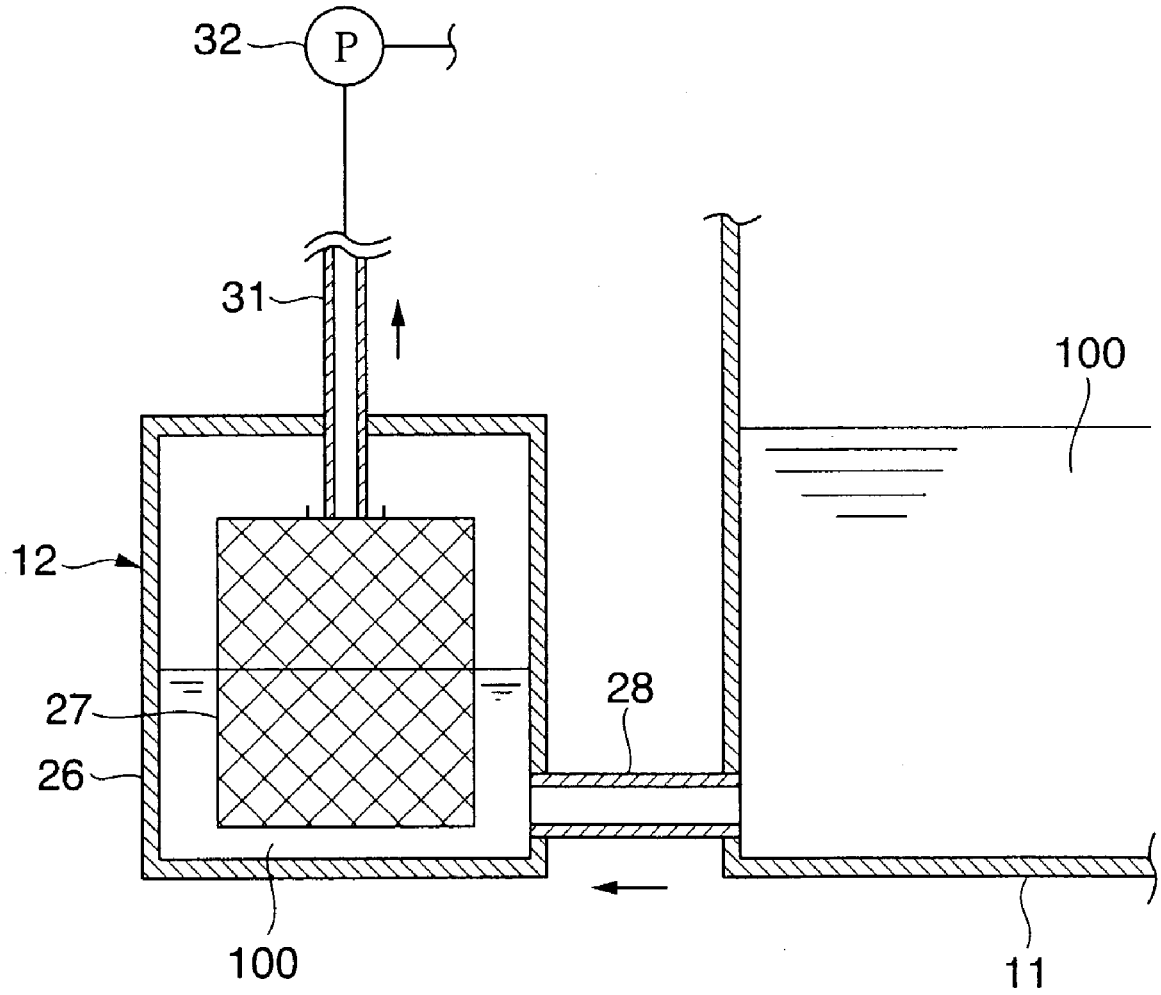
FIG. 2 is an enlarged side view of a part of the fluid injection and recovery device in the vicinity of a filter unit.
Figure 3:
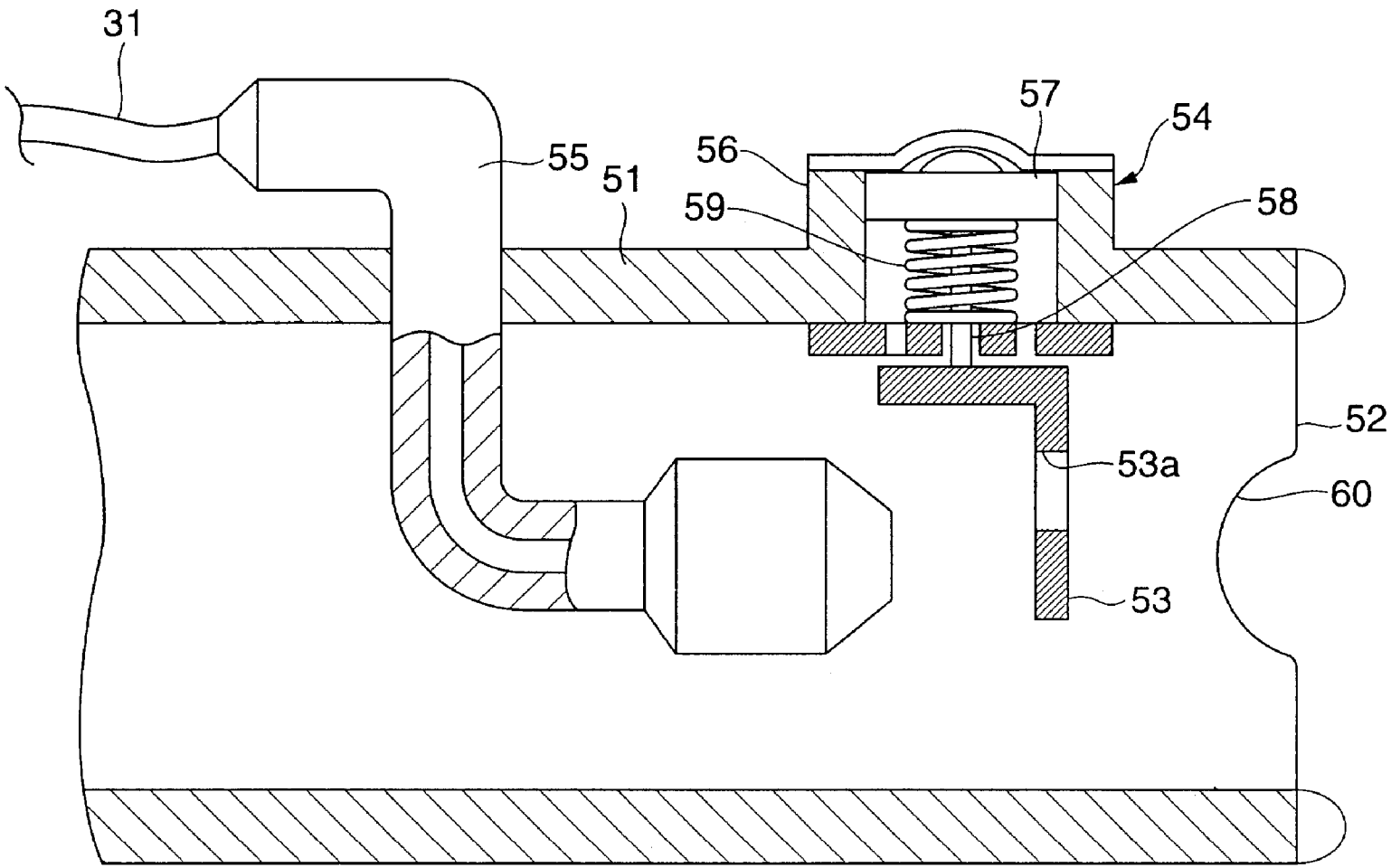
FIG. 3 is a sectional view of the fluid injection and recovery device as taken along line III—III of FIG. 1.
Figure 4:
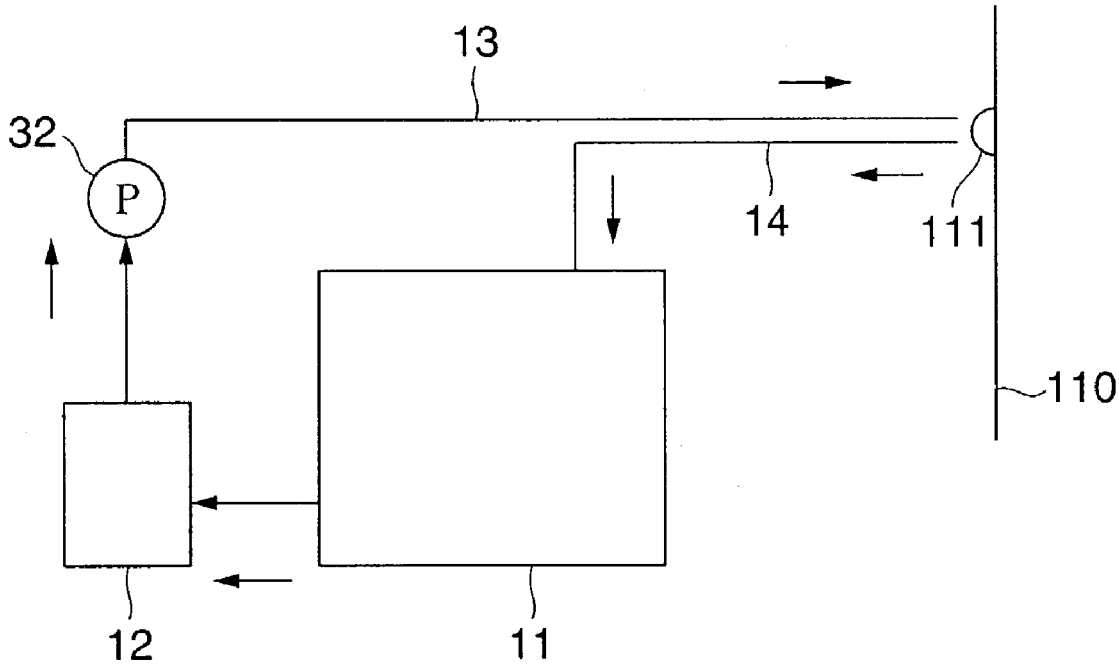
FIG. 4 is a conceptual drawing illustrative of the fluid circulation of the fluid injection and recovery device in FIG. 1.

FIG. 1 is a schematic view of the fluid injection and recovery device according to Embodiment 1 of this invention. FIG. 2 is an enlarged side view of a part of the fluid injection and recovery device in the vicinity of a filter unit. FIG. 3 is a sectional view of the fluid injection and recovery device as taken along line III—III of FIG. 1. FIG. 4 is a conceptual drawing illustrative of the fluid circulation of the fluid injection and recovery device in FIG. 1.

Embodiment 1 is explained below by referring to an example in which the object is a wall, the matter removed by the fluid is dirt adhered to the wall, and the fluid is a cleaning solvent.

As shown in FIGS. 1 through 4, a fluid injection and recovery device 1 according to Embodiment 1 comprises: a main tank 11 capable of containing a cleaning solvent 100; a filter unit 12 which is connected to the main tank and filters the cleaning solvent 100 contained in the main tank 11; a fluid sprayer 13 which is connected to the filter unit 12 and sprays the cleaning solvent 100 filtered by the filter unit 12 over a wall 110 that is the object; a recovery unit 14 which is connected to the main tank 11 and recovers, into the main tank 11, the cleaning solvent 100 sprayed over the wall 110 and the dirt 111 removed by the cleaning solvent 100; a suction unit 15 which is connected to the main tank 11 and sucks gas contained in the main tank 11, thereby creating negative pressure in the main tank 11; a heater 16 which is connected to the main tank 11 and controls the temperature of the cleaning solvent 100 contained in the main tank 11; a control panel 17 for controlling the operation of the fluid injection and recovery device 1; and a base 18 capable of moving with all the described components mounted thereon.

The main tank 11 has a generally cylindrical shape that can be hermetically sealed, and possesses enough strength to withstand a reduced pressure (for example, approximately $15\times10^3$ Pa) created by the suction unit 15. Moreover, the main tank 11 is made of a material that would not be damaged by the cleaning solvent 100 contained in the main tank 11. On the top face of the main tank 11, a filler hole 21 is formed to fill the main tank 11 with the cleaning solvent 100. At a lower part of the main tank 11, there is a drain cock 22 for externally discharging the cleaning solvent 100. On the side wall of the main tank 11, the following components are mounted: a level gauge 23 by which the volume of the cleaning solvent 100 contained in the main tank 11 can be visually checked; a fluid supply tube 31 of the fluid sprayer 13, which will be described later in detail; and hooks 24 for hanging a suction hose 35 of the recovery unit 14.

The filter unit 12 is connected via a connecting hose 28 to the main tank 11. This filter unit 12 comprises: a tank 26 into which the cleaning solvent 100 contained in the main tank 11 is supplied via the connecting hose 28; and a filter 27 which is placed within the tank 26 and filters the cleaning solvent 100. The conditions of the filter 27 such as material properties and mesh size can be selected as desired so as to perform excellent filtering, depending on, for example, the type of the cleaning solvent 100 or the dirt 111 adhered to the wall 110. It is also possible to replace the filter 27 and to remove the filter 27 from the tank 26 for cleaning.

The base end of the fluid sprayer 13 is connected to the filter 27 of the filter unit 12, and the top end of the fluid sprayer 13 comprises: a fluid supply tube 31 connected to a nozzle 36 described below in detail; and a pump 32 connected to the fluid supply tube 31. The pump 32 is used to pump up the cleaning solvent 100, which is contained in the filter unit 12 and is filtered by the filter 27, and to cause the cleaning solvent 100 to eject out of the top end of the fluid supply tube 31. This fluid supply tube 31 is secured with fasteners 33.

The base end of the recovery unit 14 is connected to the main tank 11, and the top end of the recovery unit 14 includes a suction hose 35 connected to the nozzle 36. The base end of this suction hose 35 is connected to the main tank 11 via a sealing member such as an O-ring in order to hermetically seal the main tank 11. As particularly shown in FIG. 3, the nozzle 36 comprises: a hollow nozzle body 51; a shielding plate 53 which is generally "L" shaped in its cross section and is placed within the nozzle body 51; and a driving unit 54 connected to the shielding plate 53 in order to displace the shielding plate 53. Within the nozzle 36, the top end of the fluid supply tube 31 is located in a state supported by a hollow stay 55. The cleaning solvent 100 ejecting out of the top end of the fluid supply tube 31 passes through the stay 55 and then sprays out of an opening 52 formed on the top-end side of the nozzle body 51 toward the dirt 111 adhered to the wall 110.

The shielding plate 53 is generally "L" shaped and in about a center area of a substantially vertical portion of the shielding plate 53 that defines the letter "L" shape, an aperture 53*a* is formed. Concerning the driving unit 54, a piston member 57 placed in a space within an annular guide wall 56 is connected via a shaft member 58 to the shielding plate 53. On this shaft member 8, a coil-shaped spring 59 for urging the piston member 57 upwards is mounted. The driving unit 54 is constructed in such a manner that when a sufficiently negative pressure is established within the nozzle body 51, a pressure difference between atmospheric pressure and the negative pressure forces the piston member 57 to be displaced downward (in a direction towards the inside space of the nozzle body 51) against the urging force of the spring 59, and the displacement of the piston member 57 further displaces the shielding plate 53 through the intermediary of the shaft member 58. In the state where the pressure within the nozzle body 51 has not reached a sufficiently negative pressure, that is, when the nozzle 36 is placed away from the wall 110, the shielding plate 53 exists at its upper limit position where the cleaning solvent 100 expelled from the fluid supply tube 31 collides with the lower-part surface of the shielding plate 53 below the aperture 53*a*, thereby preventing the cleaning solvent 100 from ejecting out of the opening 52 of the nozzle 36. On the other hand, when a sufficiently negative pressure is established within the nozzle body 51, a pressure difference between atmospheric pressure and the negative pressure forces the piston member 57 to be displaced downward (in a direction towards the inside space of the nozzle body 51) against the urging force of the spring 59, thereby causing the cleaning solvent 100 to eject out of the aperture 53*a*.

Reference numeral 60 refers to a "notch" that serves to introduce the ambient outside air into the nozzle body 51.

For the above-described nozzle, already known nozzles as described in Japanese Patent Laid-Open (Kokai) Publication 2001-245953, Japanese Patent Laid-Open (Kokai) Publication 2001-245952, Japanese Patent Laid-Open (Kokai) Publication No. 2001-252329, Japanese Patent Laid-Open (Kokai) Publication No. 2001-276172, and Japanese Patent Laid-Open (Kokai) Publication No. 2001-299903 can be preferably used.

Around the opening 52 of the nozzle 36, for example, brushes, sponge or other attachments may be placed so that such an attachment can be used to add the action of scrubbing the dirt 111, thereby performing auxiliary removal of the dirt 111.

The suction unit 15 comprises: a fan motor 41; a suction hose 42, with its one end connected to the fan motor 41; and a separator 43 as a gas-liquid separator connected to the other end of the suction hose 42. This suction hose 42 is drawn into and is connected with the main tank 11 via a sealing member such as an O-ring in order to hermetically seal the main tank 11.

This separator 43 is placed in a case 44 which is in the main tank 11 and is located above the liquid surface of the cleaning solvent 100. The separator 43 includes a vane wheel and a water separator rotated by the vane wheel, and prevents water droplets, which are contained in the gas sucked through the suction hose 42 into the main tank 11 or which come from the liquid surface of the cleaning solvent 100, from entering the fan motor 41. For this separator 43 (gas-liquid separator), one described in Japanese Patent Laid-Open (Kokai) Publication No. HEI 10-304993 can be preferably used.

The following description is about the detailed working of the fluid injection and recovery device 1 according to Embodiment 1 to remove grease (dirt) 111 adhered to the wall 110.

A specified amount of a desired cleaning solvent 100 is contained in the main tank 11. The heater 16 keeps this cleaning solvent 100 at a certain temperature.

As the operation of the control panel 17 activates the fan motor 41 of the suction unit 15, a suction force of the fan motor 41 causes the gas in the main tank 11 to be sucked through the suction hose 42. At the time of this suction, the flow of the gas causes the vane wheel of the separator 43 to turn. At the same time, the water separator turns to cast off, by means of centrifugal force, the cleaning solvent 100 which has scattered with the gas at the time of suction, so that the separator 43 prevents the cleaning solvent 100 from being sucked into the fan motor 41. The sucked gas passes through the fan motor 41 and exits via a specified exhaust port.

On the other hand, the operation of the pump 32 causes the cleaning solvent 100 in the tank 26 of the filter unit 12 to be pumped up and supplied via the fluid supply tube 31 to the nozzle 36. In this state where the nozzle 36 is placed away from the wall 110 and, therefore, a sufficiently negative pressure is not established within the nozzle body 51. Accordingly, the piston member 57 is located at the upper limit position of the shielding plate 53 and the cleaning solvent 100 ejecting out of the fluid supply tube 31 collides with the lower-part surface of the shielding plate 53 below the aperture 53*a* and, therefore, does not eject out of the opening 52 of the nozzle 36.

When the nozzle 36 is in the above-described state and its opening 52 is pressed against the wall 110, the suction force of the suction unit 15 creates a sufficiently negative pressure within the nozzle body 51. In other words, a pressure difference between atmospheric pressure and the negative pressure forces the piston member 57 of the driving unit 54 to be displaced downward (in a direction towards the inside space of the nozzle 36) against the urging force of the spring 59. Furthermore, the displacement of the piston member 57 displaces the shielding plate 53 through the intermediary of the shaft member 58, thereby expelling the cleaning solvent 100 through the aperture 53*a* toward the wall 110.

Through the above-described action, the cleaning solvent 100 sprayed from the opening 52 of the nozzle 36 over the wall 110 with the adhered dirt 111 removes the dirt 111 off the wall 110 by means of its spraying force and cleaning force. The wastewater containing the removed dirt 111 and the sprayed cleaning solvent 100 is immediately sucked via the nozzle 36 into the suction hose 35 and is recovered into the main tank 11. Therefore, the sprayed cleaning solvent 100 and the removed dirt 111 will not run down the wall 110 or make the floor or the like dirty. As a result, in the main tank 11, the cleaning solvent 100 and the recovered wastewater coexist.

The cleaning solvent 100 and the wastewater contained in the main tank 11 are supplied, by means of the operation of the pump 32, to the filter unit 12, where the mixture is filtered by the filter 27, and the resultant fluid is supplied again as the cleaning solvent 100 to the nozzle 36.

As shown in FIG. 4, the fluid injection and recovery device 1 of Embodiment 1 repeats the following cycle:

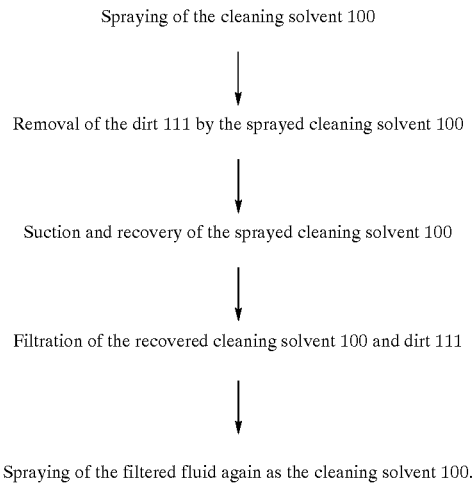

As a result, it is possible to recycle the cleaning solvent 100 efficiently and to lengthen the intervals to refill the main tank 11 with the cleaning solvent 100. Accordingly, it is possible to extend the continuous operation time of the fluid injection and recovery device 1, to enhance the work efficiency, and to reduce the amount of the cleaning solvent 100 to be disposed.

During the cleaning work, the volume of the cleaning solvent 100 in the main tank 11 can be visually checked through a level gauge 23. If the main tank 11 no longer contains a sufficient amount of the cleaning solvent 100, an appropriate amount of the cleaning solvent 100 may be added through the filler hole 21. If the entire cleaning solvent 100 in the main tank 11 is replaced with a new cleaning solvent 100, it is possible to easily dispose of the cleaning solvent 100 in the main tank 11 by opening the cock 22. When the cleaning work is finished, the suction hose 35 and the fluid supply tube 31 can be held on the hooks 24, so that the suction hose 35 and the fluid supply tube 31 can be kept in a compact space.

The fluid injection and recovery device 1 can be placed within any housing which is not shown in the drawing. Moreover, since the base 18 is provided with wheels 19 and a handle 20, it is possible to easily move the fluid injection and recovery device 1.

(Embodiment 2)

The fluid injection and recovery device according to Embodiment 2 of this invention is described below with reference to the relevant drawings.

Figure 5:
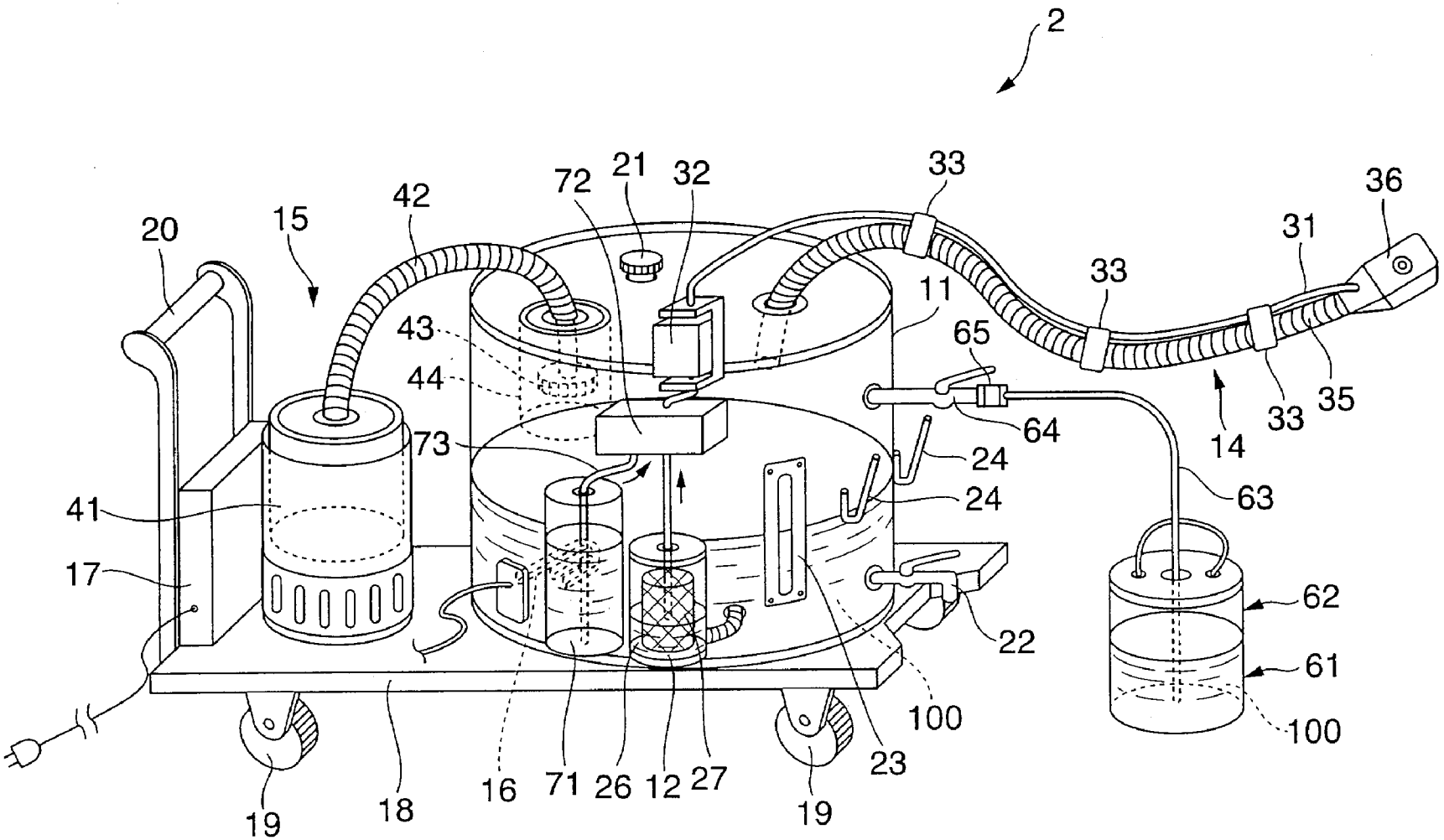
FIG. 5 is a schematic view of the fluid injection and recovery device according to Embodiment 2 of this invention.

FIG. 5 is a schematic view of the fluid injection and recovery device according to Embodiment 2 of this invention. For Embodiment 2, elements similar to those used in the fluid injection and recovery device 1 of Embodiment 1 are given the same reference numerals, and any detailed description of such elements is omitted here.

As shown in FIG. 5, the main difference between a fluid injection and recovery device 2 of Embodiment 2 and the fluid injection and recovery device 1 of Embodiment 1 is that a supply tank 61 for refilling the main tank 11 with the cleaning solvent 100 and a sub-tank 71 capable of containing a finishing liquid for cleaning are connected to the main tank 11, and the filter unit 12 is connected via a magnetic valve 72 to the pump 32.

The supply tank 61 can contain the cleaning solvent 100, and one end of a supply tube 63 for supplying the cleaning solvent 100 to the main tank 11 is inserted into the supply tank 61. The other end of this supply tube 63 is connected via a coupler 65 to a cock 64 which is attached to the main tank 11. The negative pressure in the main tank 11 as created by the suction of gas by the suction unit 15 is utilized to automatically move (or supply) the cleaning solvent 100 contained in the supply tank 61 to the inside of the main tank 11.

The sub-tank 71 is connected with a supply tube 73 for supplying the finishing liquid for cleaning 101 contained in the sub-tank 71. This supply tube 73 is connected via the magnetic valve 72 to the pump 32. The filter unit 12 is also connected via the magnetic valve 72 to the pump 32. In other words, by switching the position of the magnetic valve 72, it is possible to select, as appropriate, to supply either the cleaning solvent 100 contained in the filter unit 12 or the finishing liquid for cleaning 101 to the fluid supply tube 31.

The following description is about the detailed working of the fluid injection and recovery device 2 according to Embodiment 2.

In the initial state of the fluid injection and recovery device 2 to start the removal (or cleaning) of the dirt 111 adhered to the wall 110, the magnetic valve 72 is set so as to supply the cleaning solvent 100 contained in the filter unit 12 to the fluid supply tube 31. The cock 64 connected to the supply tank 61 is then closed.

In the above-described state, the control panel 17 is operated in the same manner as with the fluid injection and recovery device 1 of Embodiment 1 in order to activate the fan motor 41, thereby creating a negative pressure in the main tank 11. Moreover, the pump 32 is operated to pump up the cleaning solvent 100 contained in the tank 26 of the filter unit 12, thereby supplying the cleaning solvent 100 via the fluid supply tube 31 to the nozzle 36.

When the nozzle 36 in the above-described state is pressed against the wall 110, a sufficiently negative pressure is established within the nozzle body 51 and the piston member 57 of the nozzle 36 displaces in a direction toward the inside space of the nozzle 36, thereby expelling the cleaning solvent 100 through the aperture 53*a* toward the wall 110.

In the same manner as Embodiment 1, according to the above-described action, the cleaning solvent 100 sprayed from the opening 52 of the nozzle 36 over the wall 110 with the adhered dirt 111 removes the dirt 111 off the wall 110 by means of both its spraying force and cleaning force. The wastewater containing the removed dirt 111 and the sprayed cleaning solvent 100 is immediately sucked via the nozzle 36 into the suction hose 35 and is recovered into the main tank 11.

The cleaning solvent 100 and the wastewater, which are contained in the main tank 11, are supplied, by means of the operation of the pump 32, to the filter unit 12, where the mixture of the cleaning solvent 100 and the wastewater is filtered, and the resultant fluid is supplied again as the cleaning solvent 100 to the nozzle 36.

While this action is repeated, if it is visually observed through the level gauge 23 that the water level of the cleaning solvent 100 in the main tank 11 has lowered and it is confirmed that the main tank 11 has to be refilled with the cleaning solvent 100, the cock 64 is opened to cause the cleaning solvent 100 contained in the supply tank 61 to move into the main tank 11. At this time, since a negative pressure is established within the main tank 11, it is possible to cause the cleaning solvent 100 contained in the supply tank 61 to move into the main tank 11 without connecting any equipment such as a pump to the supply tank 61.

As described above, it is possible to easily refill the main tank 11 with the cleaning solvent 100 without interrupting the operation of the fluid injection and recovery device 2 by simply opening the cock 64.

The main tank 11 may be equipped with, for example, a warning mechanism for informing the user when the water level of the cleaning solvent 100 contained in the main tank 11 becomes lower than a certain level.

Accordingly, the fluid injection and recovery device 2 of Embodiment 2 can recycle the cleaning solvent 100 in the same manner as the fluid injection and recovery device 1 of Embodiment 1. Moreover, the fluid injection and recovery device 2 can easily refill the main tank 11 with the cleaning solvent 100.

After the cleaning of the wall 100 using the cleaning solvent 100 has finished, the control panel 17 is operated to switch the position of the magnetic valve 72 in order to supply the finishing liquid for cleaning 101 from the sub-tank 71 to the fluid supply tube 31. For this finishing liquid for cleaning 101, it is possible to preferably use, for example, water, warm water, hot water, or other kinds of fluid that can be used as a finishing liquid for cleaning purposes. This finishing liquid for cleaning 101, as with the cleaning solvent 100 described above, is also sprayed out of the opening 52 of the nozzle 36 toward the wall 110 and is recovered, together with a residue of the cleaning solvent 100 sprayed over the wall 110 and a residue of the dirt 111 removed by the cleaning solvent 100, via the suction hose 35 into the main tank 11.

Accordingly, even if the cleaning solvent 100 contained in the main tank 11 is a detergent such as a strong alkaline cleaning solvent, the dirt 111 is first removed by using this cleaning solvent 100 and the magnetic valve 72 is then switched to spray the finishing liquid for cleaning 101 over the area that has been cleaned, so that the residue of the cleaning solvent 100 and the dirt 111 can be removed and recovered without fail. Therefore, the labor of wiping becomes unnecessary, which further simplifies the cleaning work.

Embodiment 2 describes the case in which both the supply tank 61 and the sub-tank 1 are attached. However, this invention is not limited to this construction, and only either the supply tank 61 or the sub-tank 1 may be attached.

Figure 6:
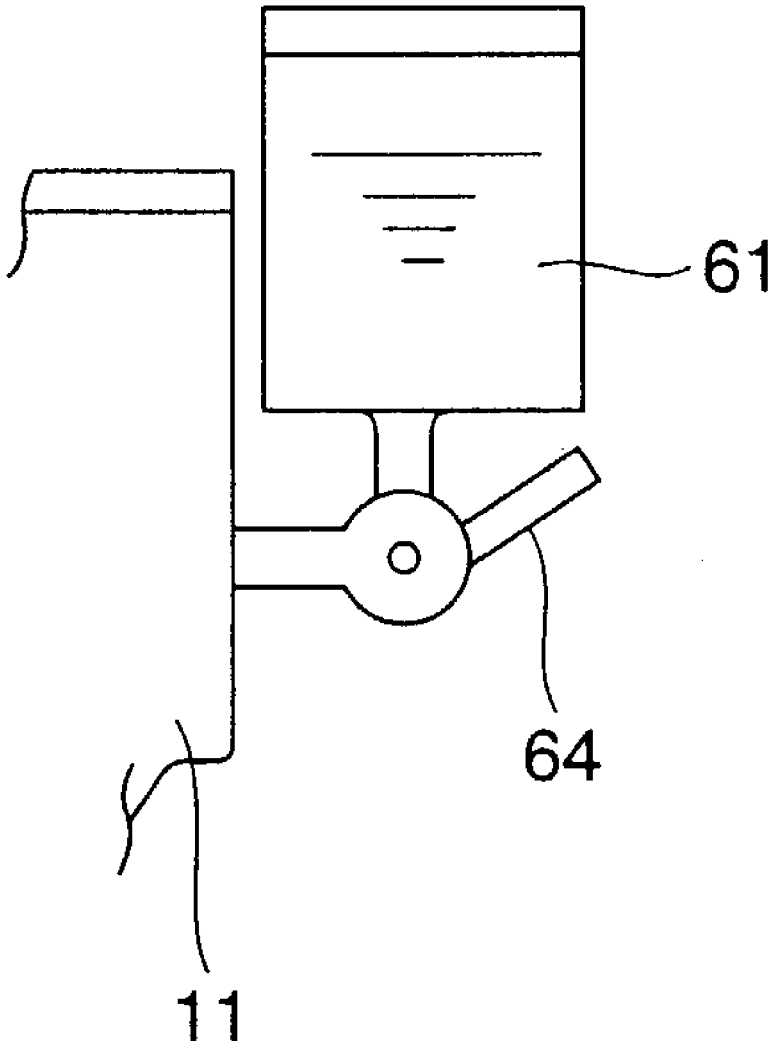
FIG. 6 is a schematic view of a supply tank part of the fluid injection and recovery device according to another embodiment of this invention.

Moreover, Embodiment 2 describes the case in which the supply tank 61 is an independent unit separate from the main tank 11 and the supply tank 61 and the main tank 11 are connected to each other via the supply tube 63. However, this invention is not limited to this construction and, for example, as shown in FIG. 6, the supply tank 61 may be directly attached to the main tank 11.

Furthermore, Embodiment 2 describes the case in which the sub-tank 71 contains the finishing liquid for cleaning 101. However, this invention is not limited to this construction, and the sub-tank 71 may contain any fluid such as other various kinds of cleaning solvents or glazing agents.

Embodiments 1 and 2 describes the case in which the dirt 111 adhered to the wall 110 is removed (or cleaned). However, this invention is not limited to this usage, and the fluid injection and recovery device of this invention can clean a variety of objects by changing, for example, the type of the cleaning solvent 100.

(Embodiment 3)

The fluid injection and recovery unit according to Embodiment 3 of this invention is described below with reference to the relevant drawings.

Figure 7:
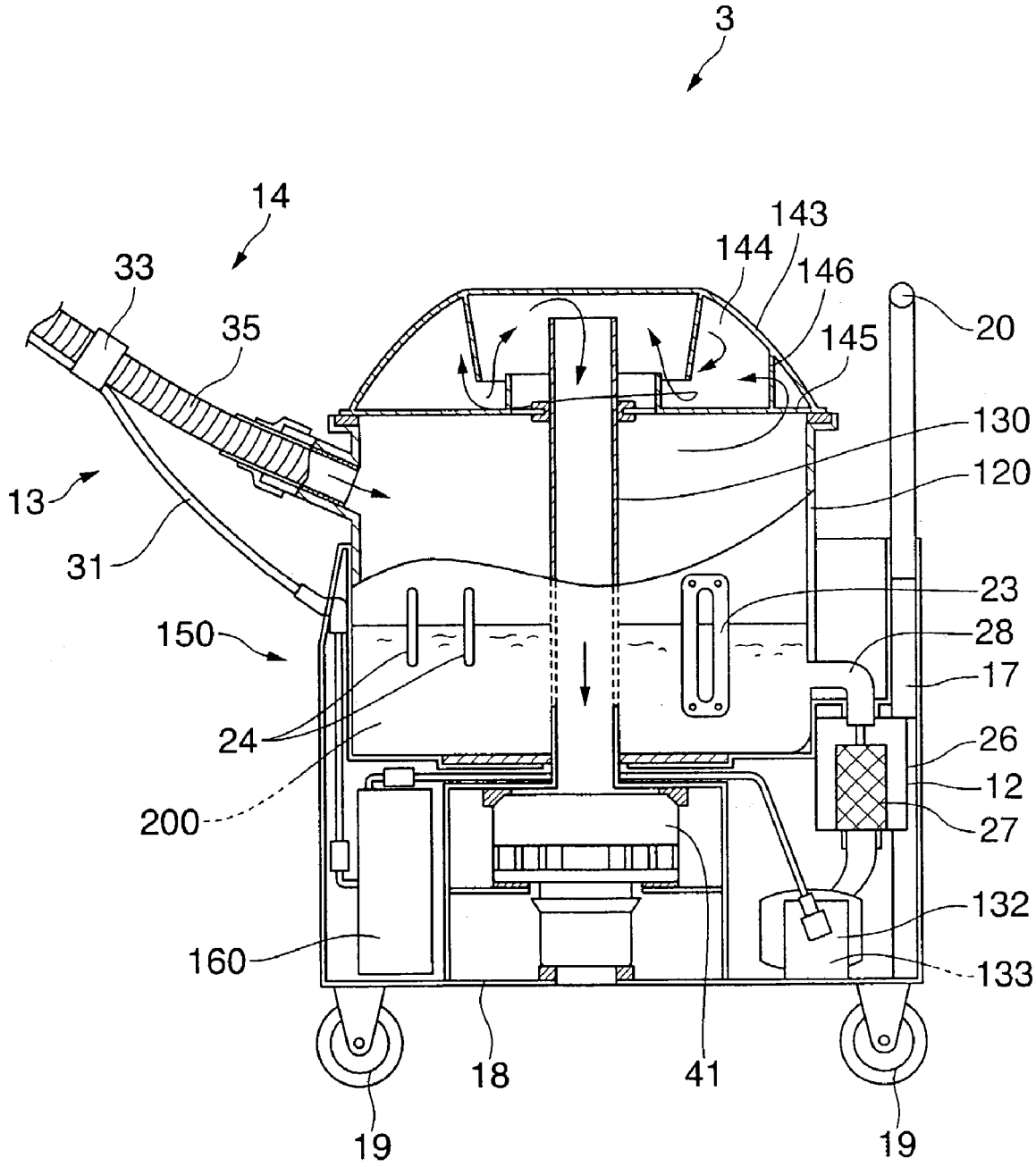
FIG. 7 is a partial cut side view of the fluid injection and recovery device according to Embodiment 3 of this invention.
Figure 8:
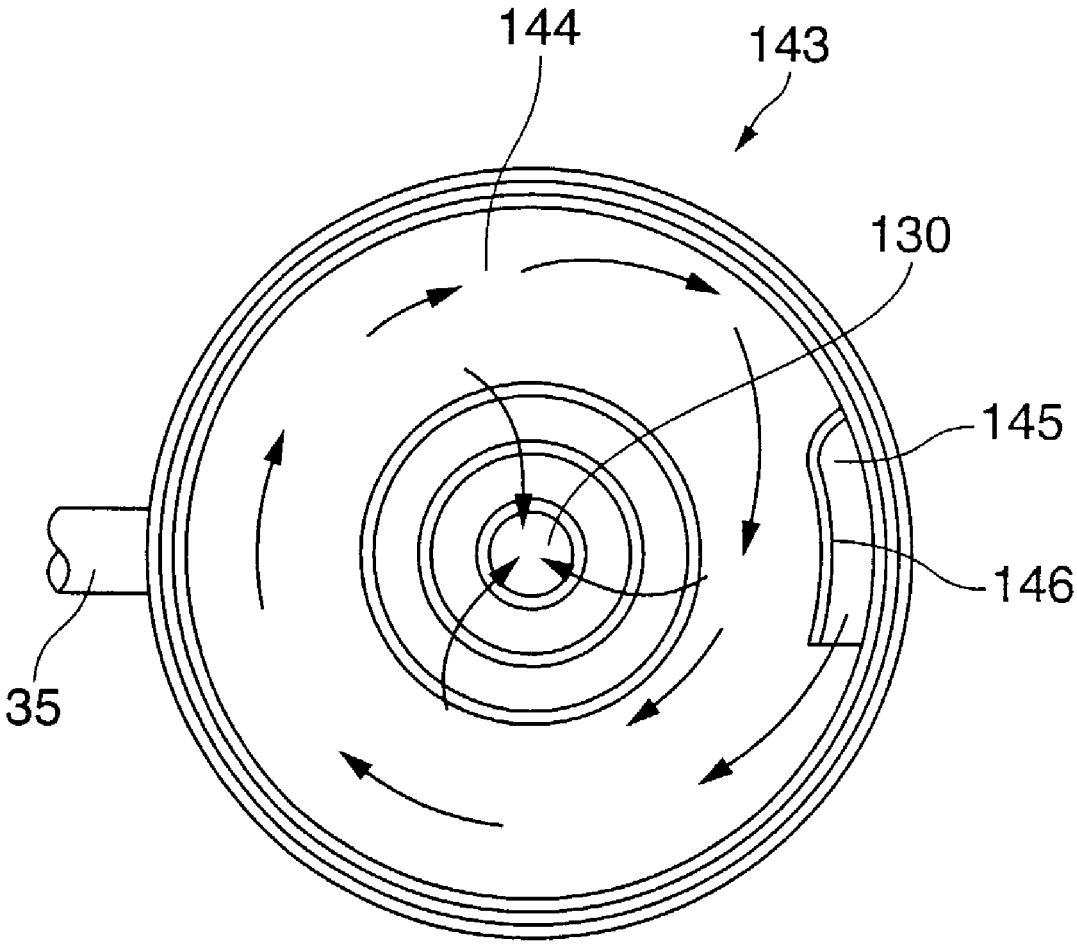
FIG. 8 is a plan view of a separator part of the fluid injection and recovery device of FIG. 7.
Figure 9:
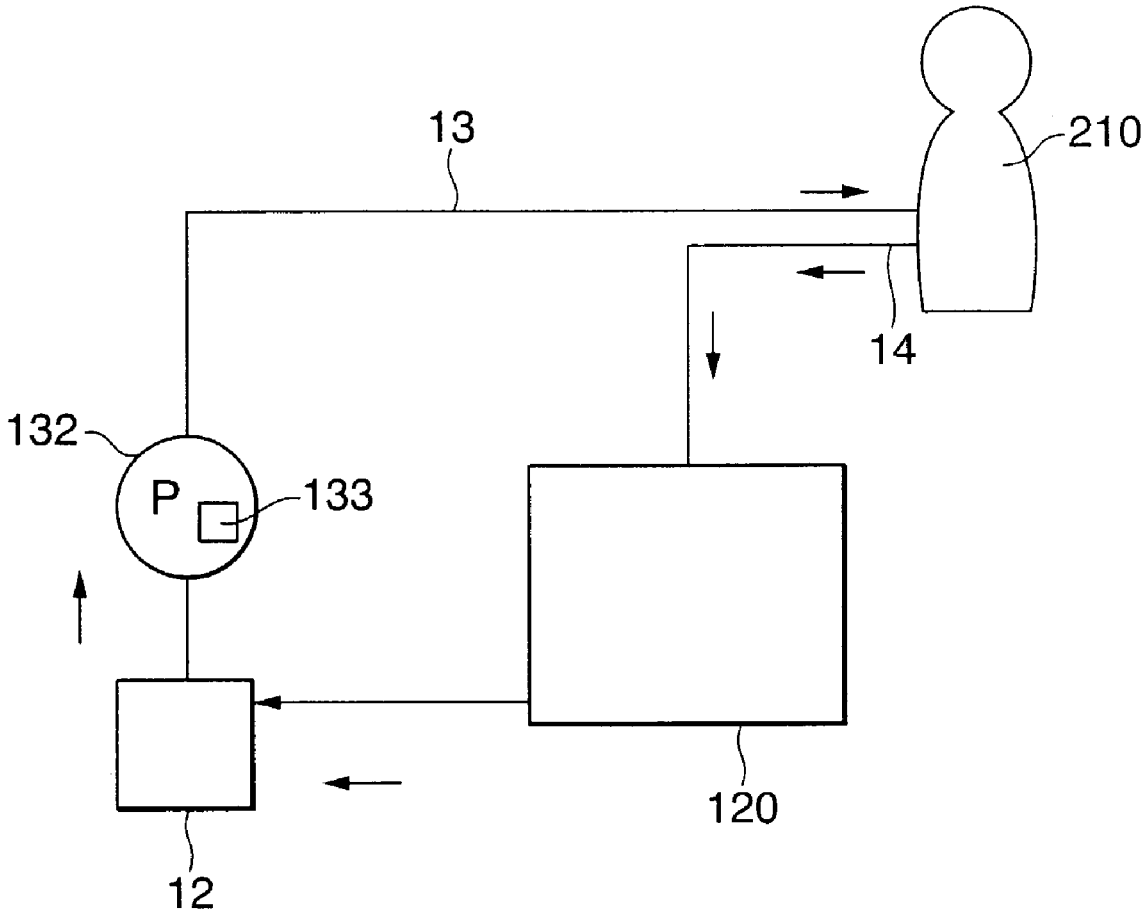
FIG. 9 is a conceptual drawing illustrative of the fluid circulation of the fluid injection and recovery device of FIG. 7.

FIG. 7 is a partial cut side view of the fluid injection and recovery device according to Embodiment 3. FIG. 8 is a plan view of a separator part of the fluid injection and recovery device of FIG. 7. FIG. 9 is a conceptual drawing illustrative of the fluid circulation of the fluid injection and recovery device of FIG. 7.

Embodiment 3 is explained below by referring to an example in which the object is a human body, and the fluid is water (or hot water). For Embodiment 3, elements similar to those used in the fluid injection and recovery devices 1 and 2 according to the aforementioned embodiments are given the same reference numerals, and any detailed description of such elements is omitted here.

As shown in FIGS. 7 through 9, a fluid injection and recovery device 3 according to Embodiment 3 comprises: a main tank 120 capable of containing water 200; a filter unit 12 which is connected to the main tank 120 and filters the water 200 contained in the main tank 120; a fluid sprayer 13 which is connected to the filter unit 12 and sprays the water 200 filtered by the filter unit 12 over a human body 210 that is the object; a recovery unit 14 which is connected to the main tank 120 and recovers, into the main tank 120, the water 200 sprayed over the body 210; a suction unit 150 which is connected to the main tank 120 and sucks gas contained in the main tank 120, thereby creating negative pressure in the main tank 120; a heater 160 which is connected to the main tank 120 and controls the temperature of the water 200 supplied from the main tank 120 via the filter unit 12; a control panel 17 for controlling the operation of the fluid injection and recovery device 3; and a base 18 capable of moving with all the described components mounted thereon.

The main tank 120 has a generally cylindrical shape, which can be hermetically sealed and has a hollow part in approximately its center area. The main tank 120 possesses enough strength to withstand a reduced pressure (for example, approximately $15\times10^3$ Pa) created by the suction unit 150. Moreover, the main tank 120 is made of a material that would not be damaged by the fluid contained in the main tank 120. On the top face of the main tank 120, a separator 143 described later in detail is placed. At a lower part of the main tank 120, there is a cock (not shown in the drawing), which is similar to the drain cock 22 used in the aforementioned embodiments, for externally discharging the water 200. On the side wall of the main tank 120, the following components are mounted: a level gauge 23 by which the volume of the water 200 contained in the main tank 120 can be visually checked; a fluid supply tube 31 of the fluid sprayer 13; and hooks 24 for hanging a suction hose 35 of the recovery unit 14. Moreover, regarding the hollow part formed in the approximately center area of the main tank 120, a duct 130 is placed, which has its upper end connected to the separator 143 and its lower end connected to a fan motor 41.

The base end of the fluid sprayer 13 is connected to the filter 27 of the filter unit 12, and the top end of the fluid sprayer 13 comprises: a fluid supply tube 31 connected to the nozzle 36 (see FIGS. 1 and 3) used in the aforementioned embodiments; and a pump 132 connected to the fluid supply tube 31. This pump 132 is used to pump up the water 200, which is contained in the filter unit 12 and is filtered by the filter 27, and to cause the water 200 to eject out of the top end of the fluid supply tube 31. The pump 132 is connected to a pressure control unit 133 for controlling the pressure of the water 200 to be sprayed. This pressure control unit 133 can control the water pressure, as desired, at the time of spraying the water 200 (hot water) over the body 210. By controlling the water pressure, it is also possible to obtain a massage effect using the water 200. The pressure control unit 133 may be set so as to switch the pressure of the water 200 to be sprayed between a few stages, for example, "strong," "moderate," and "weak," or an even more gradual control operation may be performed. The operation of the pressure control unit 133 may be conducted by using a switch (not shown in the drawing) on the control panel 17 or by remote control with, for example, a controller.

The suction unit 150 comprises: a fan motor 41 positioned below the main tank 120; a duct 130 with its one end connected to the fan motor 41; and a separator as a gas-liquid separator, which is connected to the other end of the duct 130 and is positioned above the main tank 120.

This separator 143 is generally dome-shaped having generally a circular cross section as viewed from above as illustrated in FIG. 8. In the separator 143, there is a fluid chamber 144 into which the gas-liquid mixture is introduced. In the fluid chamber 144, a suction opening 145 is formed to introduce the gas-liquid mixture from the main tank 120. Moreover, in order to generate a spiral flow in the fluid chamber 144, a suction guide 146, which is constructed to cause the suction of the gas-liquid mixture in a tangent direction, is formed in the fluid chamber 144 and is connected to the suction opening 145. The gas-liquid mixture introduced into the fluid chamber 144 undergoes separation between gas and liquid according to the cyclone principle, and the separated gas is sucked via the duct 130 by the fan motor 41. This construction prevents water droplets from entering the fan motor 41.

The heater 160 is positioned outside of the main tank 120 and maintains the water 200 supplied by the pump 132 via the filter unit 12 from the main tank 120 at a certain temperature. This water (hot water) 200 kept at a certain temperature passes through the fluid supply tube 31 and is sprayed from the nozzle 36 (see FIGS. 1 and 3) over the body 210.

The following description is about the detailed working of the fluid injection and recovery device 3 according to Embodiment 3 to apply a massage effect to the body 210.

A specified amount of the water 200 is contained in the main tank 120. When the control panel 17 is operated to activate the fan motor 41 of the suction unit 150, a suction force of the fan motor 41 causes the gas-liquid mixture in the main tank 120 to be introduced through the suction hole 145 into the fluid chamber 144 of the separator 143. The gas-liquid mixture introduced through the suction hole 145 is guided by the suction guide and generates a spiral flow in the fluid chamber 144 as indicated with arrows in FIGS. 7 and 8. This action causes the separation of the gas-liquid mixture between gas and liquid according to the cyclone principle, thereby preventing the water 200 from entering the fan motor 41. The gas sucked via the duct 130 by the fan motor 41 passes through the fan motor 41 and exits via a specified exhaust port.

On the other hand, the operation of the pump 132 causes the water 200 in the tank 26 of the filter unit 12 to be pumped up. At this time, the pump 132 causes the pressure control unit 133 to control the pressure of the water 200 to be expelled out of the nozzle. The heater 160 maintains the pumped water 200 at a desired temperature, and the water (hot water) 200 kept at a certain temperature is supplied via the fluid supply tube 31 to the nozzle 36 (see FIGS. 1 and 3).

In this state where the nozzle 36 is placed away from the body 210 and, a sufficiently negative pressure is not established within the nozzle body 51 as described in the aforementioned embodiments. Accordingly, the piston member 57 is located at the upper limit position of the shielding plate 53 and the water 200 ejecting out of the fluid supply tube 31 collides with the lower-part surface of the shielding plate 53 below the aperture 53*a* and, therefore, does not eject out of the opening 52 of the nozzle 36. When the nozzle 36 is in the above-described state and its opening 52 is pressed against the body 210, the suction force of the suction unit 150 creates a sufficiently negative pressure within the nozzle body 51. In other words, a pressure difference between atmospheric pressure and the negative pressure makes the piston member 57 of the driving unit 54 to be displaced downward (in a direction toward the inside space of the nozzle 36) against the urging force of the spring 59. Furthermore, the displacement of the piston member 57 displaces the shielding plate 53 through the intermediary of the shaft member 58 thereby expelling the water 200 out of the aperture 53*a* toward the body 210.

Through the above-described action, the water (hot water) 200 sprayed from the opening 52 of the nozzle 36 over the body 210 can achieve a massage effect for the body 210. The water 200 sprayed over the body 210 is immediately sucked via the nozzle 36 into the suction hose 35 and is recovered into the main tank 120. For example, if the water 200 sprayed over the body 210 causes aged skin and dirt to come off the body 210, they are recovered, together with the water 200, into the main tank 120. On the other hand, if the aged skin and dirt have not come off the body 210, only the water 200 is recovered into the main tank 120. Therefore, the sprayed water 200 will not run down to wet the user's clothes, blankets, floor or the like. As a result, in the main tank 120, the water 200 and the recovered liquid coexist.

The water 200 and the liquid recovered into the main tank 120 are supplied, by means of the operation of the pump 132, to the filter unit 12, where the mixture is filtered by the filter 27, and the resultant water is supplied via the fluid supply tube 31 to the nozzle 36.

As shown in FIG. 9, the fluid injection and recovery device 3 of Embodiment 3 repeats the following cycle:

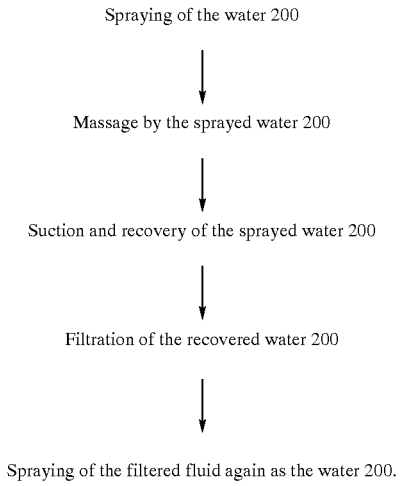

As a result, it is possible to recycle the water 200 efficiently and to lengthen the intervals to refill the main tank 120 with the water 200. Accordingly, it is possible to extend the continuous operation time of the fluid injection and recovery device 3.

While Embodiments 1 and 2 describes the case in which the object is a wall, the matter removed by the fluid is dirt adhered to the wall, and the fluid is a cleaning solvent, Embodiment 3 describes the case in which the object is the human body 210 and the fluid is the water (hot water) 200, which is used to apply a massage effect to the body 210. However, this invention is not limited to this usage. As mentioned earlier in this specification, there is no special limitation on the object, as long as the fluid expelled out of the fluid injection and recovery device of this invention can be sprayed over the object.

In other words, the fluid injection and recovery devices 1 and 2 of Embodiments 1 and 2 can be used for the purpose of applying a massage to the body 210 as with Embodiment 3. In this case, the fluid injection and recovery devices 1 and 2 may be equipped with the pressure control unit 133. Also, the fluid injection and recovery unit 3 of Embodiment 3 may be used as a cleaning device.

Moreover, by controlling the pressure of the fluid expelled out of the nozzle 36 as desired, the fluid injection and recovery device of this invention can be utilized, for example, as a facial treatment device. In this case, the object is a human face, and the fluid is water (hot water or water vapor), cosmetic lotions, cosmetic toners, cosmetic essence, moisture lotions, or solutions or vapors containing aromatic essence.

Furthermore, if the pressure of the fluid expelled out of the nozzle 36 is set to high pressure, it is possible to cut into or process materials such as concrete, stones, or metals by expelling a water jet out of the nozzle 36.

As described above, the fluid injection and recovery device of this invention can filter, by means of the filter unit, the fluid which has been recovered by the recovery unit into the main tank, and can spray the filtered fluid again from the fluid sprayer over the object. Accordingly, it is possible to recycle the fluid efficiently and to lengthen the intervals to refill the main tank with the fluid. As a result, it is possible to extend the continuous operation time of the fluid injection and recovery device, to enhance the work efficiency, and to reduce the amount of the fluid to be disposed of.

I claim:

1. A fluid injection and recovery device comprising:

a main tank capable of containing a fluid;

a filter unit which is connected to the main tank and is capable of filtering the fluid contained in the main tank;

a fluid sprayer which is connected to the filter unit and sprays the fluid filtered by the filter unit over an object; and a recovery unit which is connected to the main tank and is capable of recovering, into the main tank, at least, the fluid sprayed over the object and which includes a suction hose connected to the main tank, and a nozzle including a nozzle body connected to a top end of the suction hose, said nozzle body including an opening, which can be placed facing the object and a suction hole for sucking in at least the fluid sprayed over the object wherein a top end of the fluid sprayer is connected to the nozzle in such a way that said fluid is only sprayed from said nozzle opening when a sufficiently negative pressure is established within the nozzle body from the suction hose.

2. The fluid injection and recovery device according to claim 1, wherein the recovery unit is capable of recovering the fluid sprayed over the object and the matter removed by the fluid.

3. The fluid injection and recovery device according to claim 1, wherein the suction hole is used to suck in the fluid sprayed over the object and the matter removed by the fluid.

4. The fluid injection and recovery device according to claim 1, wherein the main tank is connected to the suction unit for sucking gas contained in the main tank, thereby creating negative pressure in the main tank.

5. The fluid injection and recovery device according to claim 4, wherein the fluid is a liquid, and the suction unit includes a gas-liquid separator for separating gas from liquid in the main tank and sucks the gas contained in the main tank through the gas-liquid separator, thereby creating negative pressure in the main tank.

6. The fluid injection and recovery device according to claim 5, wherein the gas-liquid separator comprises a fluid chamber into which a gas-liquid mixture is introduced, and a spiral flow is generated in the fluid chamber, thereby separating gas from liquid according to the cyclone principle.

7. The fluid injection and recovery device according to claim 4, wherein the recovery unit employs the negative pressure in the main tank in order to recover, into the main tank, at least, the fluid sprayed over the object.

8. The fluid injection and recovery device according claim 7, wherein the recovery unit recovers the fluid sprayed over the object and the matter removed by the fluid.

9. The fluid injection and recovery device according to claim 1, wherein the fluid sprayer comprises: a fluid supply tube connected to the filter unit; and a pump for supplying the fluid filtered by the filter unit to the fluid supply tube, thereby causing the fluid to eject out of the top end of the fluid supply tube.

10. The fluid injection and recovery device according to claim 1, wherein the main tank is connected to a supply tank for refilling the main tank with the fluid.

11. The fluid injection and recovery device according to claim 4, wherein the main tank is connected through a cock to a supply tank for refilling the main tank with the fluid, and when the cock is in the open position, the negative pressure in the main tank causes the fluid in the supply tank to move to the main tank.

12. The fluid injection and recovery device according to claim 1, wherein the main tank is connected to a thermoregulator capable of adjusting the temperature of the fluid contained in the main tank.

13. The fluid injection and recovery device according to claim 1, wherein the fluid contained in the main tank is an alkaline cleaning solvent.

14. The fluid injection and recovery device according to claim 1, further comprising a sub-tank capable of containing the fluid, wherein the filter unit and the sub-tank are connected through a switching valve to the fluid sprayer, and supplying the fluid to the fluid sprayer is controlled by the operation of the switching valve.

15. The fluid injection and recovery device according to claim 1, wherein the fluid contained in the sub-tank is a finishing liquid for cleaning, and the fluid sprayed from the main tank over the object and residue of the matter removed by the fluid are recovered by the recovery unit into the main tank.

16. The fluid injection and recovery device according to claim 1, further comprising a pressure control unit for controlling the pressure of the fluid expelled out of the fluid sprayer.

17. The fluid injection and recovery device according to claim 1, further comprising a flow volume control unit for controlling the flow volume of the fluid expelled out of the fluid sprayer.

18. The fluid injection and recover device of claim 1, wherein said nozzle body includes a pressure-operated shielding plate that prevents fluid from being sprayed from said nozzle opening unless said sufficiently negative pressure is established within the nozzle.

* * * * *